United States Patent [19]

Penninger et al.

[11] Patent Number: 4,909,987

[45] Date of Patent: Mar. 20, 1990

[54] AROYLCARBOXYLIC ACID CORROSION INHIBITORS

[75] Inventors: Josef Penninger, Hilden; Juergen Geke, Duesseldorf, both of Fed. Rep. of Germany

[73] Assignee: Henkel Kommanditgesellschaft auf Aktien, Duesseldorf, Fed. Rep. of Germany

[21] Appl. No.: 241,797

[22] Filed: Sep. 6, 1988

Related U.S. Application Data

[63] Continuation of Ser. No. 102,281, Sep. 28, 1987, abandoned, which is a continuation of Ser. No. 912,136, Sep. 23, 1986, abandoned, which is a continuation of Ser. No. 661,535, Oct. 16, 1984, abandoned.

[30] Foreign Application Priority Data

Oct. 27, 1983 [DE] Fed. Rep. of Germany ..... 3338953

[51] Int. Cl.[4] ..... C23F 11/00

[52] U.S. Cl. ..... 422/17; 422/14; 252/388; 252/389.62; 252/396

[58] Field of Search ..... 422/14, 17; 252/388, 252/389.62, 396

[56] References Cited

U.S. PATENT DOCUMENTS 4,366,076 12/1982 Clark ..... 252/34
4,473,583 9/1984 Bianchi et al. ..... 424/316
4,686,084 8/1987 Geke et al. ..... 422/17

FOREIGN PATENT DOCUMENTS 57-114670 7/1982 Japan ..... 422/17
59-133377 7/1984 Japan ..... 422/17

OTHER PUBLICATIONS

Natarajan et al., "Substituted Benzoates as Corrosion Inhibitors . . . "Indian J. of Tech., vol. 8, Mar. 1970, pp. 98–100.

*Primary Examiner*—David L. Lacey
*Assistant Examiner*—Lori-Ann Johnson
*Attorney, Agent, or Firm*—Ernest G. Szoke; Wayne C. Jaeschke

[57] ABSTRACT

Alkali and/or salts of compounds of the formula:

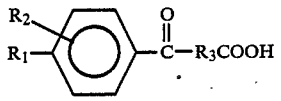

wherein $R_1$ and $R_2$ independently are H or $C_{1-6}$-alkyl and $R_3$ is CH=CH, $(CH_2)_2$ or $(CH_2)_3$, are used as metal corrosion inhibitors in aqueous systems.

13 Claims, No Drawings

AROYLCARBOXYLIC ACID CORROSION INHIBITORS

This application is a continuation, of application Ser. No. 102,281, filed 09/28/87 now abandoned; which is a continuation of Ser. No. 912,136 filed 09/23/86 now abandoned; which is a continuation of Ser. No. 661,535 filed 10/16/84 now abandoned.

BACKGROUND OF THE INVENTION

1. Field of the Invention

This invention relates to the use of special aroylcarboxylic acids as corrosion inhibitors in aqueous systems.

2. Statement of the Related Art

Corrosion prevention in aqueous systems is a major problem in industrial processes involving susceptible metals, such as copper, zinc or aluminium. Previously, the use of corrosion inhibitors, for example in cleaning preparations, cooling lubricants, hydraulic fluids or cooling waters, has often resulted in a number of practical problems. Foam suppression, solubility, and stability in hard water, are all important to the usefulness of corrosion inhibitors. In addition, the toxicity and degradability of corrosion inhibitors and also their shelf life are crucial factors.

Long chain aliphatic sulfonamidocarboxylic acids and arylsulfonamidocarboxylic acids have recently been proposed as corrosion inhibitors. However, they are only effective against corrosion when used in high concentrations and, in many cases, do not satisfy the performance standards mentioned above.

DESCRIPTION OF THE INVENTION

It has now been found that excellent results are obtained when alkali and/or ammonium salts of at least one compound corresponding to the following Formula

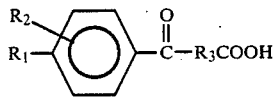

(I)

in which $R_1$ and $R_2$ independently are hydrogen or a $C_{1-6}$-alkyl radical and $R_3$ is CH=CH, $(CH_2)_2$ or $(CH_2)_3$, are used as corrosion inhibitors in aqueous systems.

Compounds corresponding to Formula I in which $R_1$ is a $C_{3-4}$-alkyl radical and $R_2$ is hydrogen are particularly suitable.

It has also been found that, in addition to alkali salts such as sodium or potassium salts, ammonium salts with organic bases are preferred, such as ammonia, mono-, di- or trialkanolamines. Diethanolamine (DEA) is particularly preferred.

Other than in the operating examples, or where otherwise indicated, all numbers expressing quantities of ingredients or reaction conditions used herein are to be understood as modified in all instances by the term "about".

The corrosion inhibitors according to the invention may be used either on their own or in admixture in the form of aqueous solutions, dispersions or emulsions optionally with compatible non-interactive adjuvants and/or carriers. They should be used in any corrosion inhibitive effective amount. They are extremely effective even in low concentrations. Thus, it has been found that, in some cases, an adequate effect is obtained with as little as 0.5 kg/m$^3$. Accordingly, the inventive corrosion inhibitors are used in quantities of from 0.5 to 10 kg/m$^3$ preferably in quantities of from 1 to 10 kg/m$^3$ and most preferably 1 to 5 kg per m$^3$ of aqueous system. In addition, the inhibitors used produce little foam and are highly stable to the hardness of water.

The aroylcarboxylic acids are produced by methods known per se. For example, they may be obtained by the Friedel-Crafts acylation of alkylbenzenes with corresponding cyclic anhydrides. The production of the aroylcarboxylic acids and their salts does not form any part of the present invention.

The corrosion inhibiting properties were determined by measuring the degree of erosion using the following procedure:

EXAMPLES A–T

Three carefully pretreated and weighed test strips (unalloyed steel, 80×15×1 mm) were suspended in a 1 liter vessel containing 800 ml of test water, 50 ml of buffer solution and a predetermined quantity of the inhibitor to be tested and left therein for 3 hours at room temperature/80 r.p.m.

The corrosion inhibition value S, based on a blank test specimen, was calculated from the weight loss.

$$S = 100(1 - a/b) \quad \begin{array}{l} a = \text{weight loss test specimen} \\ b = \text{weight loss blank value} \end{array}$$

The test water used as the corrosive medium was prepared in accordance with Deutsche Industrienorm (DIN) 51,360/2 and buffered with ammonia/ammonium chloride.

The results obtained by comparison with the prior art benzene sulfonamidocaproic acid are shown in Table 4 below. Tables 1 to 3 correlate Examples A to T with Formula I. The bases mentioned were used to neutralize the aroylcarboxylic acids.

TABLE 1

| | $R_2$ = H, $R_3$ = CH=CH | |
|---|---|---|
| Product | $R_1$ | Base |
| A | ethyl | $NH_3$ |
| B | n-propyl | DEA |
| C | iso-propyl | $NH_3$ |
| D | iso-propyl | DEA |
| E | n-butyl | $NH_3$ |
| F | n-butyl | DEA |
| G | sec.-butyl | $NH_3$ |
| H | tert.-butyl | DEA |

TABLE 2

| | $R_2$ = H, $R_3$ = $CH_2CH_2$ | |
|---|---|---|
| Product | $R_1$ | Base |
| I | n-propyl | $NH_3$ |
| J | n-butyl | $NH_3$ |
| K | tert.-butyl | $NH_3$ |
| L | tert.-butyl | DEA |

TABLE 3

| | $R_3$ = $(CH_2)_3$ | | |
|---|---|---|---|
| Product | $R_1$ | $R_2$ | Base |
| M | ethyl | H | $NH_3$ |
| N | methyl | methyl | $NH_3$ |
| O | iso-propyl | H | DEA |
| P | n-butyl | H | $NH_3$ |
| Q | n-butyl | H | DEA |

TABLE 3-continued

| Product | $R_1$ | $R_2$ | Base |
|---|---|---|---|
| | $R_3 = (CH_2)_3$ | | |
| R | sec.-butyl | H | DEA |
| S | tert.-butyl | H | $NH_3$ |
| T | tert.-butyl | H | DEA |

TABLE 4a

| Dosage | Corrosion inhibition value S in % | | | | | | | | | | |
|---|---|---|---|---|---|---|---|---|---|---|---|
| kg/m³ | A | B | C | D | E | F | G | H | I | J | K |
| 5 | 99 | 95 | 96 | 93 | 99 | 95 | 91 | 99 | 94 | 90 | 91 |
| 2.5 | 99 | 96 | 96 | 93 | 98 | 94 | 90 | 99 | 92 | 90 | 91 |
| 1 | 95 | 96 | 92 | 94 | 97 | 93 | 91 | 98 | 92 | 85 | 86 |

TABLE 4b

| Dosage | Corrosion inhibition value S in % | | | | | | | | | |
|---|---|---|---|---|---|---|---|---|---|---|
| kg/m³ | L | M | N | O | P | Q | R | S | T | U |
| 5 | 90 | 93 | 93 | 90 | 90 | 92 | 95 | 92 | 89 | 83 |
| 2.5 | 90 | 89 | 93 | 91 | 90 | 88 | 91 | 93 | 90 | 65 |
| 1 | 91 | 89 | 83 | 90 | 90 | 88 | 89 | 87 | 89 | 1 |

U = benzene sulfonamidocaproic acid in the form of the diethanolamine salt (prior art - comparative example)

ANALYSIS AND RESULTS OF TABLE 4

For the purposes of this invention, the minimum acceptable S value is 85%, with 90% being preferred and 95% being most preferred. A careful analysis of the test results indicates that it is difficult to find a statistically significant difference between the variables ($R_1$, $R_2$, $R_3$, and base). However, the S values for Examples A to H are particularly good, and these Examples are distinguished by $R_2$ being H and $R_3$ being CH=CH, $R_1$ and the base being variable.

We claim:

1. A method for inhibiting the corrosion for susceptible metals in aqueous systems comprising contacting a susceptible metal with an aqueous solution containing a corrosion inhibitive effective amount of at least one compound of alkali and/or ammonium salt of the formula:

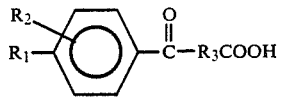

wherein:

$R_1$ is a $C_{1-6}$-alkyl;

$R_2$ is H or a $C_{1-6}$-alkyl; and $R_3$ is CH=CH, $(CH_2)_2$, or $(CH_2)_3$.

2. The method of claim 1 wherein $R_1$ is a $C_{3-4}$-alkyl and $R_2$ is H.

3. The method of claim 1 wherein $R_1$ is ethyl, methyl, n-propyl, iso-propyl, n-butyl, sec.-butyl, or tert.-butyl.

4. The method of claim 1 wherein $R_2$ is methyl.

5. The method of claim 1 wherein $R_2$ is H.

6. The method of claim 3 wherein $R_2$ is H and $R_3$ is CH=CH.

7. The method of claim 1 wherein said at least one compound is both an alkali salt and an ammonium salt and the alkali salt is sodium or potassium and the ammonium salt is ammonia, monoethanolamine, diethanolamine, or triethanolamine.

8. The method of claim 1 wherein said at least one compound is salts of ammonia or diethanolamine.

9. The method of claim 1 wherein said at least one compound is added in a quantity of about 0.5–10 kg per m³ of aqueous system.

10. The method of claim 9 wherein said at least one compound is added in a quantity of about 1–10 kg/m³.

11. The method of claim 9 wherein said at least one compound is added in a quantity of about 1–5 kg/m³.

12. The method of claim 2 wherein said at least one compound is added in a quantity of about 1–10 kg per m³ of aqueous system.

13. The method of claim 1 wherein said at least one compound is added in the form of an aqueous solution, dispersion, or emulsion.

* * * * *